US005267493A

United States Patent [19]

Yamagata et al.

[11] Patent Number: 5,267,493

[45] Date of Patent: Dec. 7, 1993

[54] FUSE PULLER

[75] Inventors: Akio Yamagata; Kazuomi Furuta, both of Shizuoka, Japan

[73] Assignee: Yazaki Corporation, Tokyo, Japan

[21] Appl. No.: 935,430

[22] Filed: Aug. 26, 1992

Related U.S. Application Data

[63] Continuation-in-part of Ser. No. 728,321, Jul. 8, 1991, abandoned, which is a continuation of Ser. No. 576,895, Jun. 25, 1990, abandoned, which is a continuation of Ser. No. 371,762, Jun. 27, 1989, abandoned.

[30] Foreign Application Priority Data

Jun. 28, 1988 [JP] Japan ..... 63-84495[U]
Aug. 26, 1991 [JP] Japan ..... 3-67513[U]

[51] Int. Cl.[5] ..... B25B 27/14

[52] U.S. Cl. ..... 81/3.8; 29/278; 294/99.1

[58] Field of Search ..... 81/3.8, 176.2; 29/278, 29/739, 758, 764; 294/99.1, 99.2

[56] References Cited

U.S. PATENT DOCUMENTS 1,886,155 11/1932 Bohlman ..... 81/3.8 X
3,052,970 9/1962 Perrin ..... 29/278 X
3,759,559 9/1973 Yuska ..... 29/278 X
4,215,468 8/1980 Greco ..... 29/278 X
4,414,698 11/1983 Epstein .
4,475,283 10/1984 Olson et al. ..... 81/3.8
4,541,311 9/1985 Trammel, Jr. .

FOREIGN PATENT DOCUMENTS 2-7843 2/1990 Japan .

*Primary Examiner*—James G. Smith
*Attorney, Agent, or Firm*—Sughrue, Mion, Zinn, Macpeak & Seas

[57] ABSTRACT

An object of the present invention resides in providing a fuse puller which assures that when a compact-size blade-type fuse is pulled away from an electric connection box or the like, there does not arise a malfunction that the fuse flies away from the fuse puller, because a fuse outlet opening of the fuse puller is kept closed with operator's fingers. According to the present invention, the fuse puller comprises a hollow rectangular parallelepiped fuse puller is constructed of a pair of wide side plates and a pair of narrow side plates, and a plurality of projections are formed on the inner wall surfaces of the side plates in the vicinity of a fuse insertion opening. The respective projections constitute engaging means in cooperation with stepped parts of grooves formed on a blade-type fuse. Slits are formed long the center line plane in the region offset from the side plates toward a fuse outlet opening while extending in the direction of extension of the fuse puller. The fuse insertion opening is dimensioned to be slightly larger than the housing of a blade-type fuse.

3 Claims, 6 Drawing Sheets

FUSE PULLER

BACKGROUND OF THE INVENTION

This application is a continuation-in-part of application Ser. 728,321 filed Jul. 8, 1991, which is a continuation application of prior Application No. 07/576,895 filed Jun. 25, 1990 (now abandoned), which in turn is a continuation of prior application No. 07/371,762, filed Jun. 27, 1989 (now abandoned).

The invention relates to a fuse puller for pulling a compact-size blade-type fuse and the invention relates to a combination of a compact-size blade-type fuse and a fuse puller for pulling the compact-size blade-type fuse.

As shown in FIG. 7, a blade-type fuse 3 comprises sheet-like blades 3*b* and 3*b* serving a male terminals and connected together by a fuse wire (not shown), and an electrically insulative resin covering the upper portions of the blades 3*b* and 3*b*. The upper end portion of the resin defines a head portion 3*a* whose opposite sides project away from each other.

The blade-type fuse 3 is adapted to fit in a female terminal provided within a fuse box (not shown). The female terminal holds the blades 3*b* and 3*b* by a strong resilient force to positively keep the contact between them. Consequently, it is not easy to pull the blade-type fuse 3 out of the female terminal. For this reason, a fuse puller 4, as shown in FIG. 8, is used.

The manner of use of fuse puller 4 will now be described with reference to FIGS. 9(*a*) to 9(*c*). The blade-type fuse 3 has stepped portions 3*c* provided as a result of the formation of the enlarged head portion 3*a*. The fuse puller 4 has a pair of legs 4*b* formed integrally with opposite sides of a spring portion 4*a*, and each leg 4*b* has an engaging pawl 4*c* formed at its lower end. As shown in FIGS. 9(*b*) and 9(*c*), the engaging pawls 4*c* are engaged with the stepped portions 3*c* of the fuse 3 to hold the fuse under the resilient force of the spring portion 4*a*. Then, the fuse puller 4 is pulled in the direction of an arrow P to pull the fuse 3 out of the female terminal.

In addition to the blade-type fuse as shown in FIG. 7, another blade-type fuse of a smaller size, as shown in FIG. 3, has recently been used. Such a compact-size blade-type fuse has no enlarged head portion, and therefore cannot be pulled out of the female terminal with the conventional fuse puller, and difficulty is encountered in pulling such from a terminal fuse.

SUMMARY OF THE INVENTION

The present invention has been made in view of the above problems, and a first object of this invention is to provide a fuse puller for pulling from a terminal a compact-size fuse of the blade-type.

A second object of the present invention resides in providing a fuse puller which assures that compact-size blade-type fuse does not fly away from the fuse puller when the compact-size blade-type fuse is pulled with operator's fingers because a fuse outlet opening of the fuse puller is kept closed.

A third object of the present invention is to provide a combination of a compact-size blade type fuse and a fuse puller for pulling the compact-size blade-type fuse.

The first object is achieved by providing a fuse puller comprising a hollow flexible body of a rectangular parallelepipedic shape, having a fuse insertion opening slightly greater in size than a head portion of a blade-type fuse; and at least one projection formed on an inner surface of said rectangular parallelepipedic body in the vicinity of the insertion opening and being engageable in a groove formed in the fuse.

To accomplish the second object, the present invention provides a fuse puller comprising a flexible hollow rectangular parallelepiped box-shaped body having a fuse insertion opening dimensioned slightly larger than the head portion of a compact-size blade-type fuse and a plurality of projections formed in the vicinity of the fuse insertion of the box-shaped body to be engaged with grooves formed on the compact-size blade-type fuse, wherein the fuse puller is constructed such that slits are formed across side plates of the box-shaped body on the fuse outlet opening side located opposite to the fuse insertion opening so as to allow a fuse outlet opening of the box-shaped body to be kept closed when the fuse outlet opening is seized with operator's fingers.

With the fuse puller of the present invention usable when a blade-type fuse is pulled away from an electric connection box or the like, slits are formed across a pair of side plates of the box-shaped body on the fuse outlet opening side located opposite to the fuse insertion opening. Since the fuse outlet opening of the fuse puller is seized with operator's fingers when the blade-type fuse is pulled away from an electric connection box or the like with the aid of the fuse puller, the slits are closed. This prevents the blade-type fuse from flying away from the fuse outlet opening by the additional action of the applied pulling force because the fuse outlet opening is kept closed with operator's fingers.

BRIEF DESCRIPTION OF THE DRAWINGS

FIG. 2(*b*) is a cross-sectional view taken along the line A—A of FIG. 2(*a*);

FIG. 2(*c*) is a cross-sectional view taken along the line B—B of FIG. 2(*a*);

Figure 3:
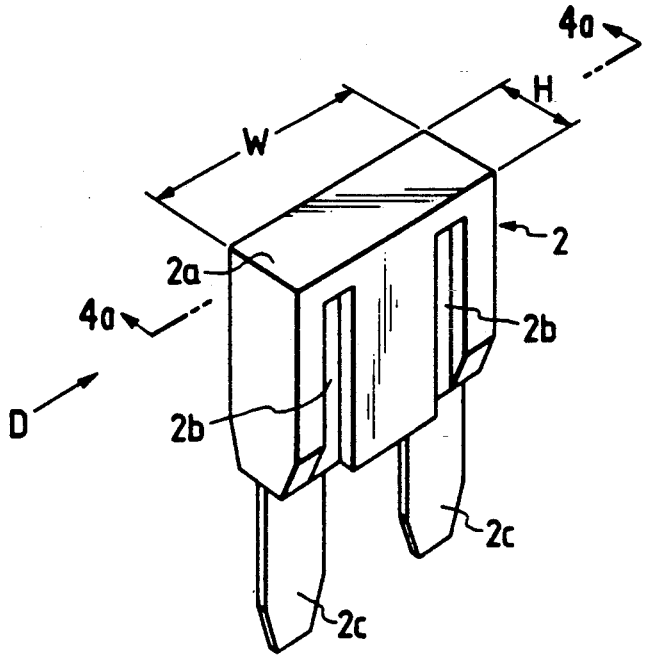
FIG. 3 is a perspective view of a compact-size blade-type fuse.
Figure 5B:
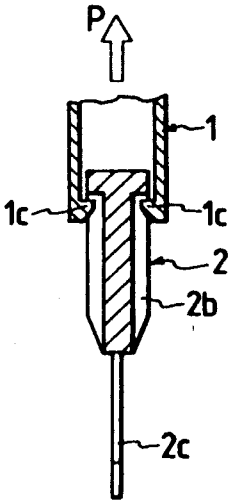
Figure 5A:
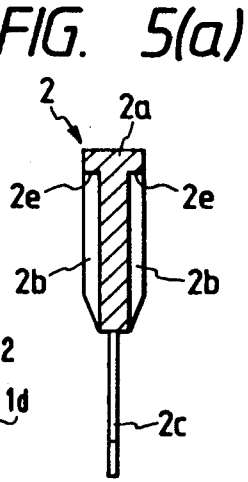
Figure 5C:
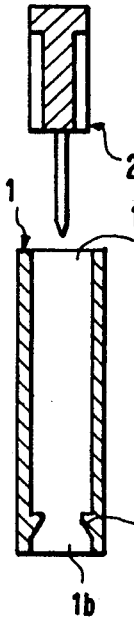

FIG. (*b*) is a view as viewed in a direction of an arrow D of FIG. 3;

FIG. 5(*a*) is a longitudinal cross-sectional view of the compact-size fuse;

FIG. 5(*b*) is a longitudinal cross-sectional view, showing the engagement between the compact-size blade-type fuse and the fuse puller;

FIG. 5(*c*) is a vertical sectional view of the first embodiment of the present invention particularly illustrating that the compact-size blade-type fuse flies away therefrom after completion of the pulling operation.

Figure 6A:
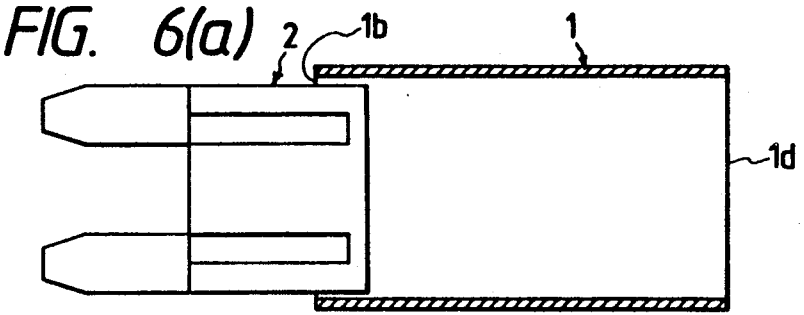
Figure 6B:
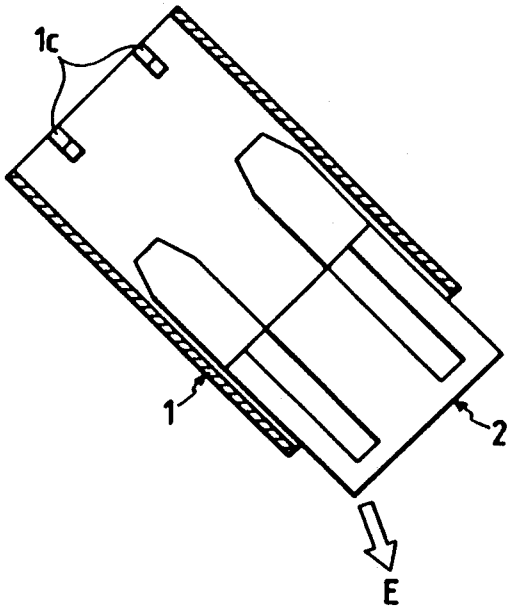
Figure 7:
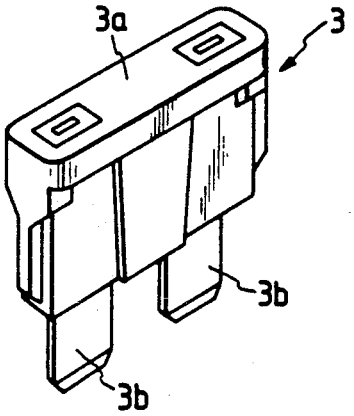
Figure 8:
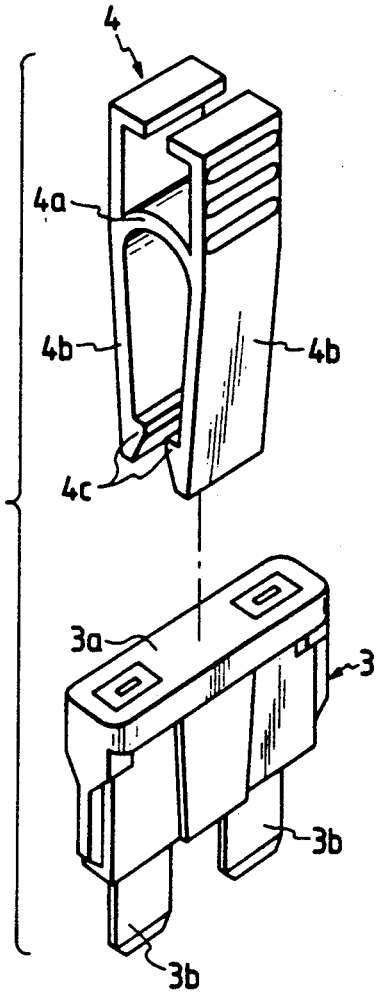
Figure 9B:
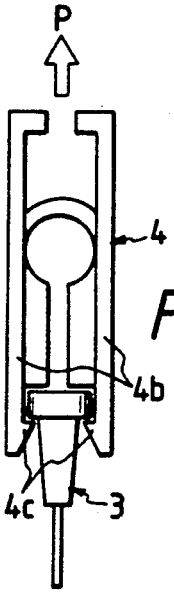
Figure 9A:
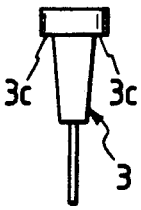
Figure 9C:
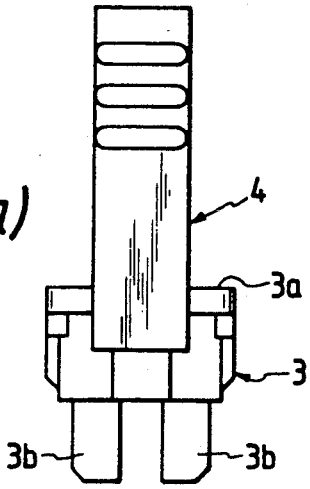
Figure 10:
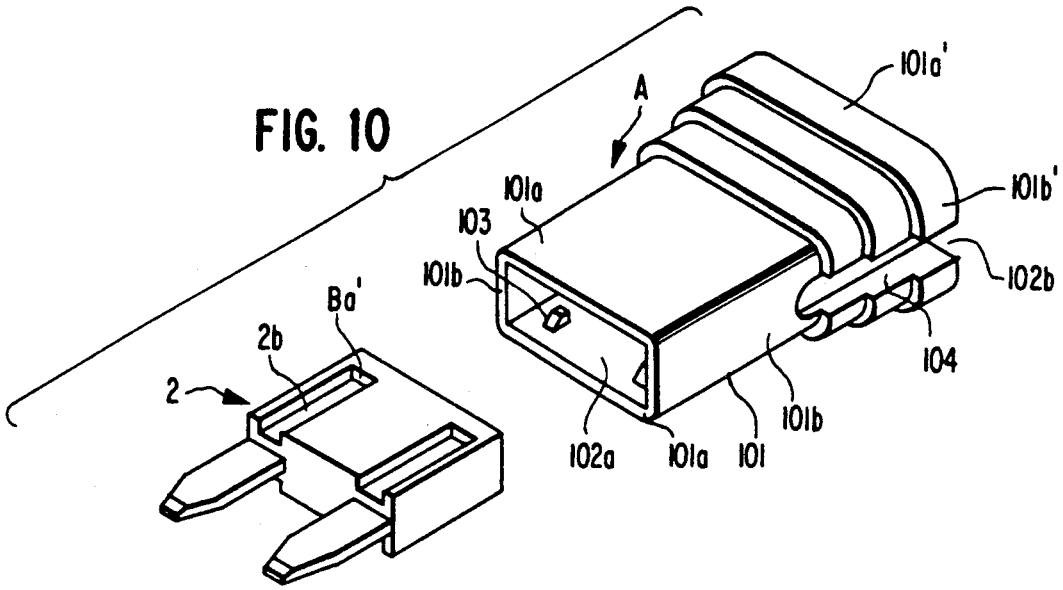
Figure 11A:
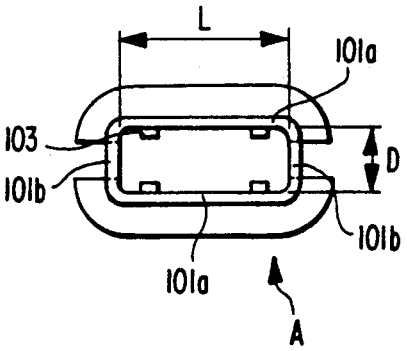
Figure 11B:
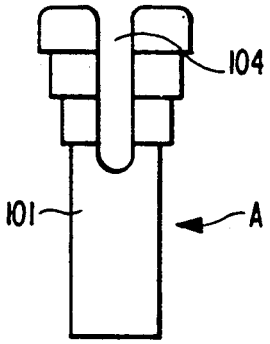
Figure 12A:
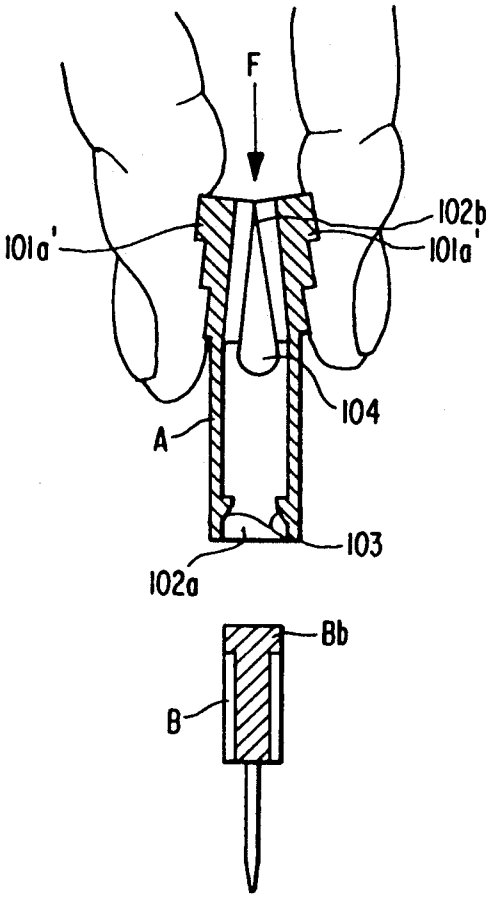
Figure 12B:
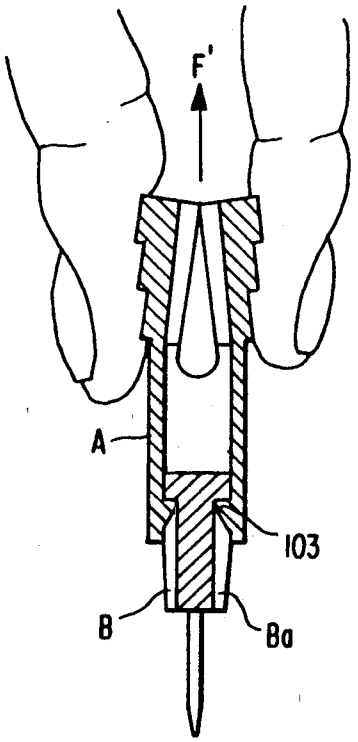
Figure 12C:
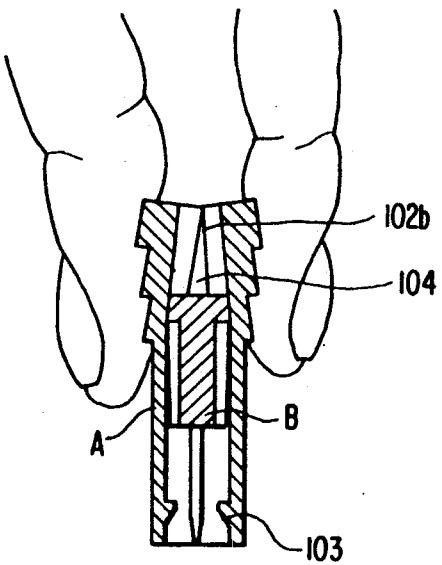

FIG. 6(*a*) is a partial cross-sectional view, showing the engagement between the compact-size blade-type fuse and the fuse puller;

FIG. 6(*b*) is a cross-sectional view, showing the condition in which the compact-size blade-type fuse is about to be discharged out of the fuse puller;

FIG. 7 is a perspective view of a conventional blade-type fuse;

FIG. 8 is a perspective view, showing the manner in which a conventional fuse puller is used with respect to he fuse;

FIGS. 9(*a*) to 9(*c*) show the manner of use of the conventional fuse puller: FIG. 9(*a*) is a view of the fuse; FIG. 9(*b*) is a side-elevational view of the fuse and the fuse puller engaged with each other; and FIG. 9(*c*) is a front-elevational view of the fuse and the fuse puller engaged with each other;

FIG. 10 is a perspective view of a fuse puller in accordance with a embodiment of the present invention;

FIG. 11(A) is a plan view of the fuse puller in accordance with the second embodiment of the present invention;

FIG. 11(B) is a side view of the same;

FIG. 12(A) is a vertical sectional view of the fuse puller in accordance with the second embodiment of the present invention, particularly illustrating the inoperative state before the fuse is fitted onto the blade-type fuse;

FIG. 12(B) is a vertical sectional view of the same, particularly illustrating the operative state after the blade-type fuse is pulled away rom an electric connection box or the like; and FIG. 12(C) is a vertical sectional view of the same, particularly illustrating the operative state after the blade-type fuse is received in the fuse puller after completion of the pulling operation.

DETAILED DESCRIPTION OF A PREFERRED EMBODIMENTS

A preferred embodiment of the invention will now be described with reference to the drawings.

Figure 4A:
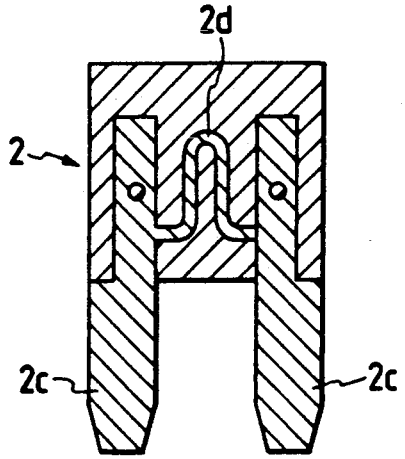
FIG. 4(*a*) is a cross-sectional view taken along the line C—C of FIG. 3.
Figure 4B:
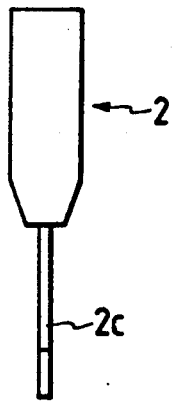

FIGS. 3 and 4 show the compact-size fuse 2 of the blade-type (hereinafter referred to as "compact fuse"), with respect to which a fuse puller of the present invention can be used. As shown in these figures, the compact fuse 2 comprises sheet-like blades 2*c* and 2*c* serving as male terminals and connected together by a fuse wire 2*d*, and an electrically-insulative resin covering the upper portions of the blades. A head portion 2*a* is not enlarged, and instead two grooves 2*b* are formed in each of the opposite sides or faces of the resin portion. The compact fuse 2 is adapted to be fitted in a female terminal, for example, of a fuse box of an automobile.

Figure 1:
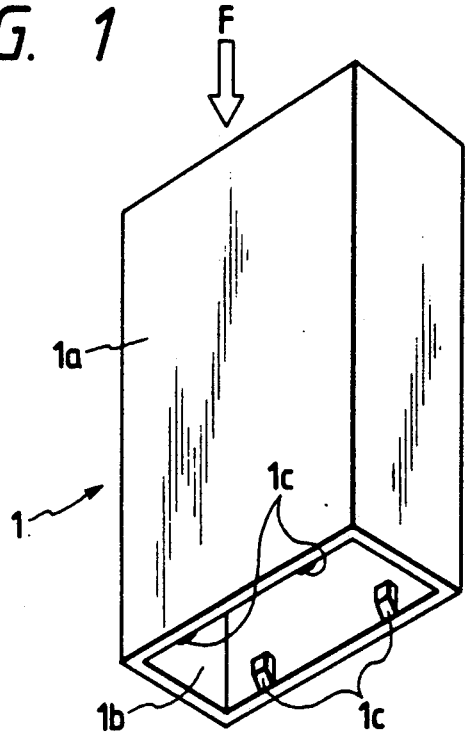
FIG. 1 is a perspective view of a fuse puller provided in accordance with a first embodiment of the present invention.

FIG. 1 shows the appearance of the fuse puller 1 of a first embodiment provided according to the present invention. The fuse puller 1 includes a hollow body 1*a* of a rectangular parallelepiped shape and made of a flexible material such as a resin. The hollow body 1*a* has a rectangular cross-section and has opposite open ends. One open end 1*b* of the rectangular parallelepiped body la serves as a fuse insertion opening. The longitudinal dimension W, of the fuse insertion opening 1*b* is slightly greater than the longitudinal dimension W of the head portion of the fuse, and the transverse dimension H' of the fuse insertion opening 1*b* is generally equal to or slightly greater than the transverse dimension H of the head portion of the fuse. The body 1*a* has projections 1*c* formed on the inner surface therefor adjacent to the insertion opening 1*b*, the projections 1*c* being adapted to be received respectively in the grooves 2*b* formed in the compact fuse 2. With the above configuration of the fuse puller 1, it can be molded of a resin by a single molding operation, such as injection molding.

Figure 2A:
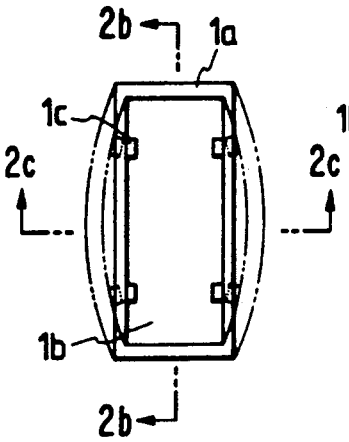
FIG. 2(*a*) is a front-elevational view of the fuse puller.
Figure 2B:
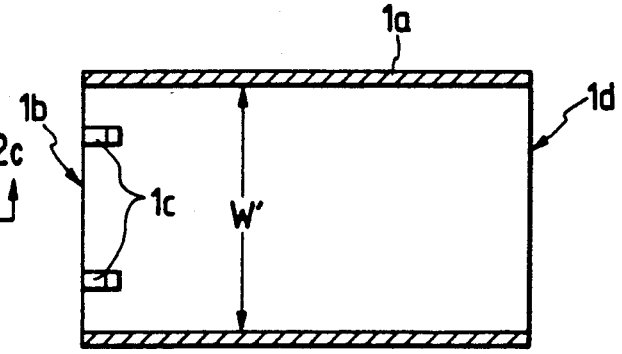
Figure 2C:
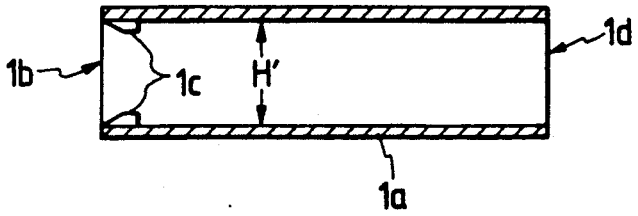

FIGS. 2(*a*) to 2(*c*) are cross-sectional views, of the fuse puller 1 of FIG. 1. The fuse puller 1 can be deformed as indicated in dots-and-dash line in FIG. 2(*a*) due to its flexible nature.

The manner of use of the fuse puller 1 will now be described. The compact fuse 2 fits in a female terminal (not shown) in such a condition as shown in FIG. 5(*a*). The fuse puller 1 is engaged with the compact fuse 2, and a force F is applied to the fuse puller 1 as indicated in FIG. 1 to press-fit the fuse puller 1 on the compact fuse 2. Each of the projections 1*c* formed in the vicinity of the insertion opening 1*b* has an inclined front surface to facilitate entry of the compact fuse 2 into the fuse puller 1. Since the insertion opening 1*b* of the fuse puller 1 is slightly greater than the head portion of the compact fuse 2, the fuse puller 1 is expanded as shown in FIG. 2(*a*), and the compact fuse 2 is forced into the insertion opening 1*b* of the thus expanded fuse puller 1. When the projections 1*c* slide over the head portion 2*a* of the compact fuse and reach the respective grooves 2*b*, the projections 1*c* are received respectively in the grooves 2*b* as shown in FIG. 5(*b*) whereupon the fuse puller 1 is returned to its original shape. When the fuse puller 1 is pulled in a direction of an arrow P (FIG. 5(*b*), each projection 1*c* is held against a shoulder 3*e* provided at the head portion and defined by the upper end of the groove 2*b*, so that the compact fuse 2 can be pulled out of the female terminal. In this embodiment, although the number of the projections 1*c* is equal to the number of the grooves 2*b*, that is to say, four, the number of the projections 1*c* may be less than the number of the groove 2*b* if there is np problem from the standpoint of the strength. For example, the provision of at least one pair of opposed projections 1*c* or at least one projection 1*c* may be sufficient.

The manner of removing the compact fuse 2 from the fuse puller 1 after the compact fuse 2 is pulled out of the female terminal will now be described. The open end 1*d* of the fuse puller 1 of the present invention opposite to the insertion opening 1*b* is also open, as shown in FIG. 6. When the fuse puller 1 is inclined as shown in FIG. 6(*b*) after the compact fuse 2 is pulled out of the female terminal as shown in FIG. 6(*a*), the compact fuse 2 is discharged from the open end 1*d* by itself.

As described above, according to the first embodiment of the present invention, the fuse puller of a simple construction of pulling the compact fuse can be provided, and the pulling of the fuse out of the female terminal, which has conventionally been carried out with the fingers, etc., with much difficulty, can be easily done. Further, the fuse puller of the present invention is of such a construction that it can be easily molded of a resin, for example, by injection molding.

A second embodiment of the present invention, as described hereinbelow provides certain advantages over the first embodiment, giving attention to the following characteristics of the first embodiment.

With the fuse puller 1 of the first embodiment of the present invention, however, there often arises a malfunction that the blade-type fuse 2 flies away from the outer end 1*d* of the fuse puller 1 by the additional action of the applied pulling force as shown in FIG. 5(*c*) until it falls down in some unrecognizable location on an engine room. In an extreme case, unexpected trouble takes place later because the flown fuse enters the rotational part of an engine.

The second embodiment of the present invention provides a fuse puller which assures that a compact-size blade-type fuse does not fly away from the fuse puller when the compact-size blade-type fuse is pulled with operator's fingers because a fuse outlet opening of the fuse puller is kept closed.

FIG. 10 is a perspective view of a fuse puller in accordance with a second embodiment of the present invention.

In FIG. 10, reference character A designates a fuse puller.

The fuse puller A comprising a hollow rectangular parallelepiped box-shaped body 101 molded of a flexible synthetic resin is constructed of a pair of wide side plates 101*a* and a pair of narrow side plates 101*b*, and opposing pairs of wedge-shaped projection 103 are formed on the inner wall surfaces of the side plates 101*a* of the box-shaped body 101 in the vicinity of a fuse insertion opening 102*a* on one side of the box-shaped body 101 while orienting toward a fuse outlet opening 102*b* on the other side of the same. With such construction, the projections 103 constitute engaging means in cooperation with stepped parts Ba, of grooves 2*b* formed on the compact-size blade-type fuse 2, as shown in FIG. 3. In addition, heavy thickness portions 101*a*' and 101*b* ' are formed in the region of the box-shaped body 101 offset from the side plates 101*a* and the side plates 101*b* toward the fuse outlet opening 102*b*.

Outward extending slits 104 are formed across the side plates 101*b* in the region of the fuse puller A offset from the side plates 101*b* toward the fuse outlet opening 102*b* while extending along a center line plane of the fuse puller A. Referring to FIG. 11(A), an inner width L between the pair of side plates 101*b* is dimensioned to be slightly larger than a width W of a housing Bb of the blade-type fuse 2, while an inner distance D between the pair of side plates 101*a* is dimensioned to be slightly larger than a thickness H of the housing Bb of the same.

When the fuse puller A constructed in the above-described manner according to the second embodiment of the present invention is used, the heavy thickness portions 101*a*' on the fuse outlet opening 102*b* side of the fuse puller A are seized with operator's fingers above the housing Bb of the compact-size blade-type fuse 2 inserted into an electric connection box or the like (not shown), and thereafter, the fuse insertion opening 102*a* of the fuse puller A is correctly vertically aligned with the housing Bb of the compact-size blade-type fuse 2, as shown in FIG. 12(A). At this time, the gap of each slit 104 is reduced with the seizing force applied thereto by operator's fingers until the outermost end edges of the inner wall surfaces of the side plates 101*a* come in contact with each other at the fuse outlet opening 102*b*.

Next, as shown in FIG. 12(A), the fuse puller A is squeezed in the F' arrow-marked direction. At this time, since the fuse puller A has flexibility, the respective projections 103 on the inner walls of the side plates 101*a* are caused to climb over the head portion of the housing Bb of the compact-size blade-type fuse 2 as the fuse puller A is squeezed further, whereby they are engaged with the grooves 2*b* on the compact-size blade-type fuse 2.

Next, when a pulling force is applied to the fuse puller A with operator's fingers in the F' arrow-marked direction as shown in FIG. 11(B), the projections 103 on the fuse puller A slidably move along the grooves Ba formed on the compact-size blade-type fuse 2 and collide against the stepped parts B*a*' of the grooves 2*b*, whereby the pulling force is applied to the compact-size blade-type fuse 2 via the projections 103. Consequently, the compact-size blade-type fuse 2 can be parted away from an electric connection box or the like with the aid of the fuse puller A.

At this time, the compact-size blade-type fuse 2 flies in the F' arrow-marked direction by the additional action of the applied pulling force. However, since the fuse outlet opening 102*b* is kept closed with operator's fingers as mentioned above, the blade-type fuse 2 is still retained in the fuse puller A (see FIG. 12(C)).

Next, the heavy thickness portions 101*a*' on the fuse outlet opening 102*b* side are released from the seized state, and the fuse puller A is then turned upside down. Now, the compact-size blade-type fuse 2 can be taken out of the interior of the fuse puller A.

Since the fuse puller is constructed in the above-described manner according to the second embodiment of the present invention, when the blade-type fuse is parted away from an electric connection box or the like into which it is inserted, it is pulled therefrom while the fuse outlet opening of the fuse puller is kept closed with operator's fingers. Thus, the following advantageous effects are obtainable. Namely, there does not arise a malfunction that it is lost immediately after completion of the pulling operation. Further, any trouble does not take place due to unexpected flying of the blade-type fuse to a remote location from the fuse puller.

After that, the extracted fuse can be removed from the fuse puller merely by tilting the end of the fuse puller and releasing the fuse outlet opening of the fuse puller from the operator's fingers to thereby allow the fuse to smoothly slide out through the fuse outlet opening of the fuse puller and into the operator's hands.

What is claimed is:

1. A fuse puller comprising:

a hollow flexible body having a fuse insertion portion provided at one end of said flexible body for receiving a head portion of a fuse, and an opening portion communicating with said fuse insertion portion through which said fuse is to be removed from said fuse puller at a desired time;

engaging means for engaging a recess portion of said fuse, said engaging means formed on an inner surface of said flexible body; and fuse extraction prevention means for at least partially closing said opening portion so as to prevent said fuse from passing through said opening portion of said fuse puller when said fuse is initially pulled out prior to the desired time.

2. A fuse puller comprising:

a hollow flexible body having a fuse insertion portion provided at one end of said flexible body for receiving a head portion of a fuse, and an opening portion communicating with said fuse insertion portion;

engaging means for engaging a recess portion of said fuse, said engaging means formed on an inner surface of said flexible body; and fuse extraction prevention means for preventing said fuse from passing through said opening portion of said fuse puller when said fuse is pulled out, wherein said fuse extraction prevention means is defined by forming slits across side plates of said body on said opening portion to allow said opening portion of said body to be kept closed when said fuse is pulled out.

3. A fuse and fuse puller assembly comprising:

a blade-type fuse including a body made of electrically-insulative resin and having a head portion and a recess portion, and a pair of blades electrically connected together, said pair of blades each having a first portion embedded into said body and a second portion extending in a first direction from a first end of said body; and a fuse puller including a hollow flexible body having a fuse insertion portion provided at one end of said flexible body for receiving a head portion of a fuse, and an opening portion communicating with said fuse insertion portion through which said fuse is to be removed from said fuse puller at a desired time;

engaging means for engaging a recess portion of said fuse, said engaging means formed on an inner surface of said flexible body; and fuse extraction prevention means for at least partially closing said opening portion so as to prevent said fuse from passing through said opening portion of said fuse puller when said fuse is initially pulled out prior to the desired time.

* * * * *